US006082785A

United States Patent [19]

Morgan et al.

[11] Patent Number: 6,082,785

[45] Date of Patent: Jul. 4, 2000

[54] BALLOON TIER AND METHOD

[76] Inventors: William R. Morgan; Eric P. Morgan, both of 1232 Pillow Ave., Harwick, Pa. 15049-8910

[21] Appl. No.: 09/199,294

[22] Filed: Nov. 24, 1998

Related U.S. Application Data

[60] Provisional application No. 60/066,854, Nov. 28, 1997.

[51] Int. Cl.[7] ..... D03J 3/00

[52] U.S. Cl. ..... 289/17; 289/2

[58] Field of Search ..... 289/17, 18.1, 2, 289/12, 13, 14, 15, 16, 16.5; 446/220, 222; 140/93.6, 101, 118, 123.5, 149

[56] References Cited

U.S. PATENT DOCUMENTS

| | | | |
|---|---|---|---|
| 2,689,147 | 9/1954 | Smalley | 289/17 |
| 4,485,852 | 12/1984 | Frazier | 140/118 |
| 4,510,653 | 4/1985 | Semanko . | |
| 4,864,762 | 9/1989 | Cox | 289/17 |
| 4,989,906 | 2/1991 | Peverley . | |
| 5,039,142 | 8/1991 | Muma . | |
| 5,314,217 | 5/1994 | Place | 289/17 |
| 5,397,326 | 3/1995 | Mangum | 289/17 |
| 5,568,950 | 10/1996 | Herren | 289/17 |
| 5,611,578 | 3/1997 | Angelico, Sr. et al. . | |

FOREIGN PATENT DOCUMENTS

| | | | |
|---|---|---|---|
| 1321066 | 6/1973 | United Kingdom | 289/17 |

*Primary Examiner*—Michael A. Neas

*Attorney, Agent, or Firm*—Daniel A. Sullivan, Jr.; Jones, Tullar & Cooper, P.C.

[57] ABSTRACT

A balloon tying device of the invention includes a dowel having a slotted end and a hole whose axis extends transversely to the dowel in the slot. A particular feature of the invention involves a stepping-in of one side of a balloon-tying slot relative to the other, to create a land for facilitating sliding of a neck of a balloon into the slot in a method of the invention.

12 Claims, 4 Drawing Sheets

BALLOON TIER AND METHOD

CROSS-REFERENCE TO RELATED APPLICATION

The benefit of provisional application No. 60/066,854 filed Nov. 28, 1997 is claimed. Provisional application No. 60/066,854 filed Nov. 28, 1997 is incorporated here by reference.

TECHNICAL FIELD

The invention relates to device and method for tying a knot in the neck of a balloon.

DISCLOSURE OF INVENTION

Objects of the invention are: to provide a novel device and method facilitating the tying of a knot in the neck of a balloon.

Other objects of the invention will become apparent from the remainder of this specification as set forth below.

Toward accomplishing one or more of the objects, a balloon tying device of the invention includes a dowel having a slotted end and a hole whose axis extends transversely to the dowel in the slot. According to another way of looking at the invention, a particular feature involves a stepping-in of one side of a balloon-tying slot relative to the other, to create a land for facilitating sliding of a neck of a balloon into the slot.

In a method of the invention, a knot is tied in a neck of a blown balloon. A slotted balloon-tier is used. The neck of the balloon is pressed against the tier to prevent gas escape, and the orifice and the neck of the balloon are brought around the tier, to crossover the neck in the direction toward the slot.

Figure 1:
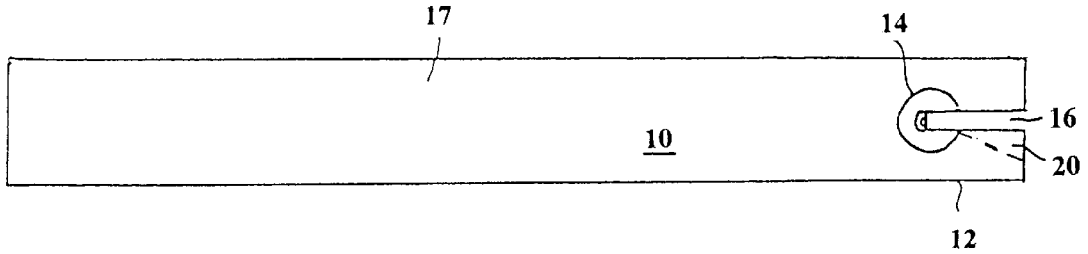
FIG. 1 is a top view of a balloon tying device of the invention.

It is to be recognized that calling FIG. 1 a top view is an arbitrary choice and that the reverse might, as well, have been used.

FIGS. 4 to 10 illustrate various stages in carrying out a balloon tying method of the invention.

Figure 11:
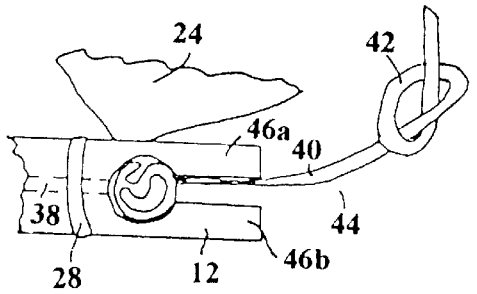

FIG. 11 shows a top view of a modified form of the invention in use.

MODES OF THE INVENTION

Figure 2:
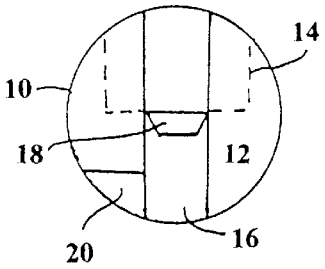
FIG. 2 is a view of the right end of the device of FIG. 1.
Figure 3:
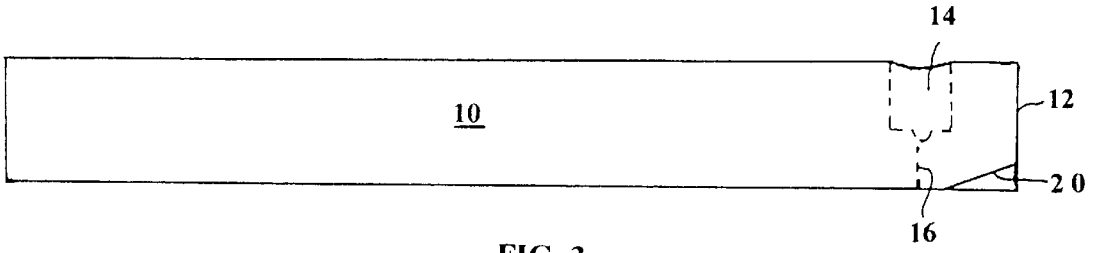
FIG. 3 is a view of the side of the device of FIG. 1.

FIGS. 1 to 3 illustrate a preferred embodiment of the invention, a construction based on a dowel 10 of round (e.g. cylindrical) shape. An end 12 has a hole 14 drilled transversely to the axis of the dowel to a depth of about one-half the total thickness of the dowel. End 12 has, as well, a slot 16 centered to include the axis of the dowel, extending across the thickness of the dowel, and cut back into the dowel about to the axis of hole 14, where it terminates. The length of the dowel adjacent end 12 forms handle 17.

As shown in FIG. 2, the slot exposes a depression 18 formed by the tip of the drill used to form hole 14. The width of the slot is constant across the dowel; thus, for instance, the width of the slot as it breaks the upper surface of the dowel is the same as the width with which it breaks the lower surface.

On the bottom or lower surface of end 12, a chamfered land 20 is located on one side of the slot, so that such side is stepped in (towards the axis of the dowel), relative to the other side of the slot at end 12.

Preferably, the dowel is of essentially constant diameter over its entire length; thus, other than the slight reduction of cross section caused by land 20, there is no tapering of end 12.

Figure 4:
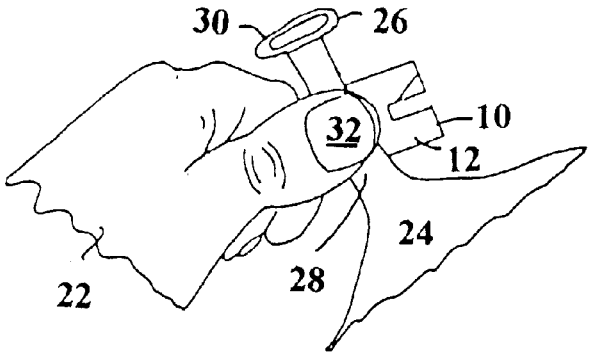

FIGS. 4–10 illustrate a method of the invention using the above-described balloon tying device. In FIGS. 5–8, the right hand has not been shown, in order to show the location of the orifice of the balloon held by the right hand in each of the illustrated steps of the method. In FIG. 4, dowel 10 is shown gripped on handle 17 by one's left hand 22. Rubber balloon 24 has been blown up by gas introduced through orifice 26 and neck 28. The orifice 26 of the balloon is formed by a circular bead 30 of rubber thicker than the remainder of the balloon. The gas used for expanding the balloon may be a person's breath, compressed air, a gas bottled under pressure, such as helium, etc. The gas is being retained in the balloon by the pressure of thumb 32 holding neck 28 against the round surface of the bottom of dowel 10. The gas seal achieved in a balloon neck by the pressing of a thumb against a round surface is more reliable than is the case for the pressing of a thumb against an edge or against a flat surface. In the position shown in FIG. 4, the orifice of the balloon lies on the same side of the slot as is the land.

In cases where the balloon is expanded using a nipple valve on a gas regulator atop a bottle of gas, the position of FIG. 4 is achieved by placing end 12 of the dowel beneath neck 28 of the balloon. When the desired amount of balloon expansion is reached, the passageway through the neck is closed by pressing thumb 32 against the round surface of the dowel. If gas pressure is still being applied, orifice 26 is then blown off the nipple. Otherwise, appropriate movement of the left hand 22 draws the orifice off the nipple.

Figure 5:
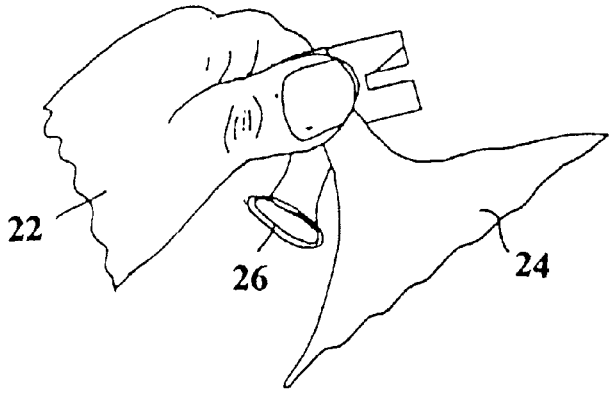

Advance to the position shown in FIG. 5 is achieved by grasping the free-standing orifice 26 in FIG. 4 with the right hand, which brings the neck, with, or without stretching, around the dowel, to the position shown in FIG. 5.

Figure 6:
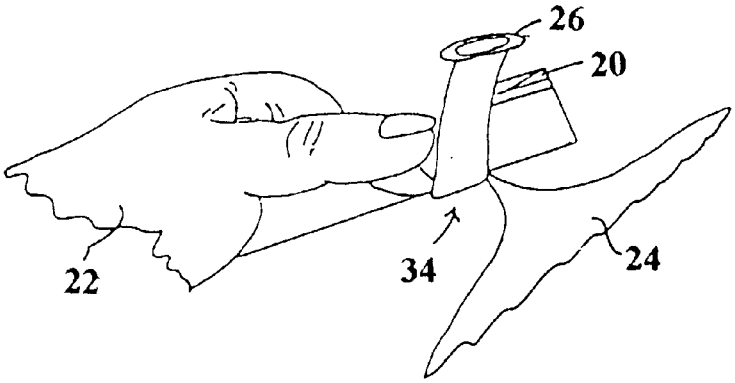

In FIG. 6, the right hand, still grasping orifice 26 and the neighboring region of the neck, further advances the neck until it passes over itself at crossover point 34 going in the direction toward slot 16, en route to being brought to land 20, as will be explained with reference to FIG. 7.

Figure 7:
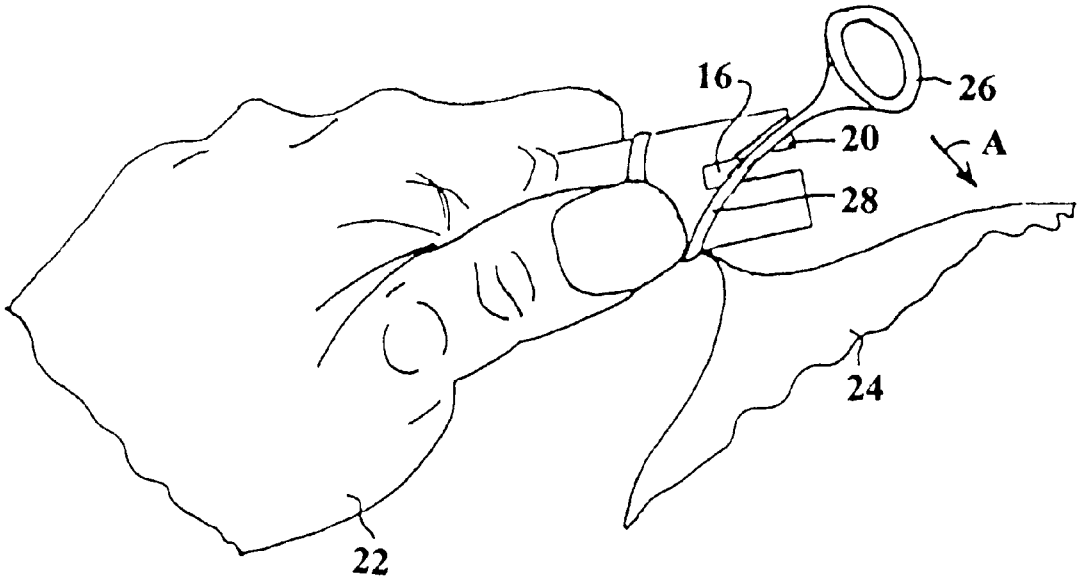
Figure 8:
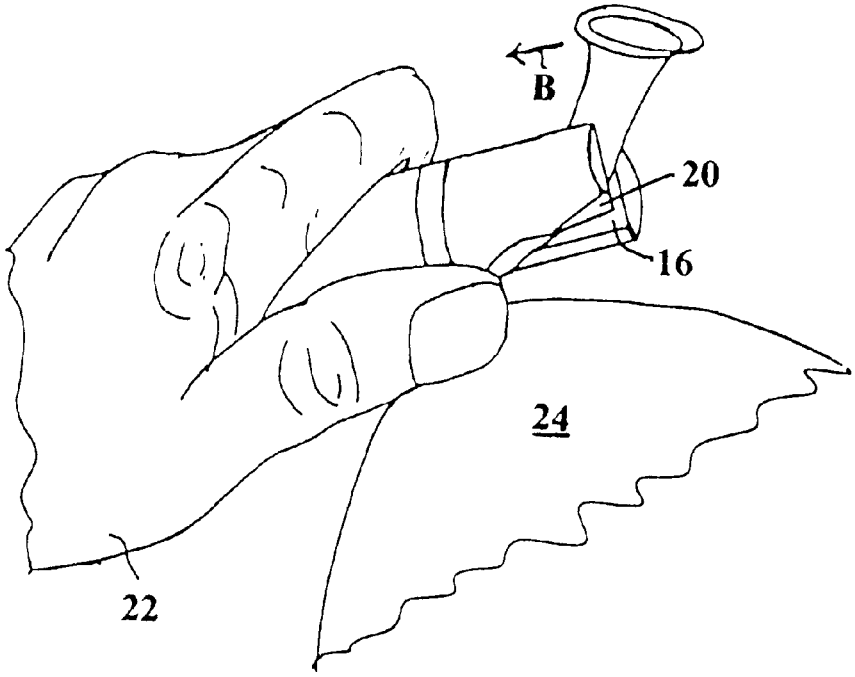

In FIG. 7, the right hand has stretched neck 28 by pulling on orifice 26, making the neck narrower, and has brought the neck onto land 20. From there, with a movement of the right hand causing sliding of the neck on the land in the direction of arrow A toward the slot 16, the neck is moved into the slot, to the position shown in FIG. 8. Further motion of the right hand, in the direction of arrow B in FIG. 8 back into the slot, aligns the neck of the balloon with the axis of hole 14. The orifice is then released, and the neck and orifice snap down into the position in hole 14 shown in FIG. 9.

Figure 9:
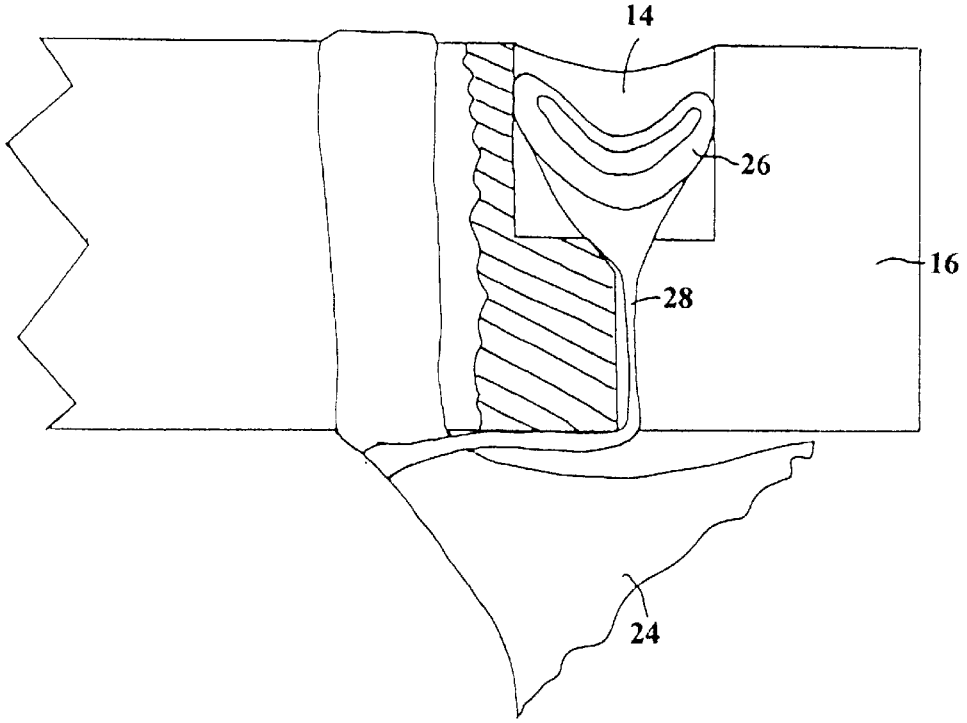

By this time, it is no longer necessary to maintain the pressure of thumb 32 on the neck of the balloon, in order to keep the balloon on the tier or to keep gas in the balloon. Rather, these functions are accomplished alone by the taut state of the balloon as shown in FIG. 9.

Figure 10:
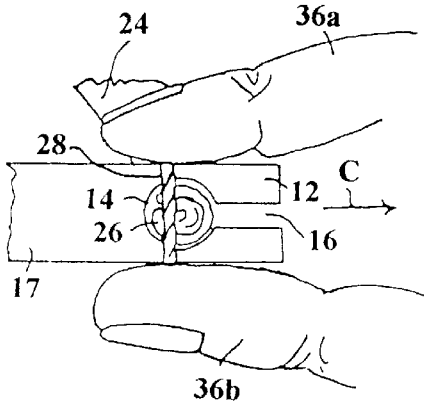

In FIG. 10, the left hand (not shown) still holds handle 17 of the balloon tier, while the index finger 36*a* and thumb 36*b* of the right hand are shown in the process of rolling neck 28 in the direction of arrow C off of end 12. The rolling neck passes over orifice 26 recessed in hole 14. The rolling motion imparts a twist to neck 28, as shown in the drawing, to improve the gas seal.

When neck 28 has been rolled off of end 12, an overhand knot results in the neck. This knot is tightened by a downward pulling on balloon 24 by one's right hand at its juncture with neck 28, against orifice 26 in hole 14 being urged upwards by the left hand on handle 17. The knotted balloon is then removed from the tier by a swinging of neck 28 upwards through slot 16, with an accompanying movement of the balloon 24 to above the dowel, such that orifice 26 can then be pulled upwards, out of hole 14.

The illustration of the invention in FIGS. 1–10 has been for a right-handed person. For a left-handed user, land 20 would preferably be on the other side of the slot, handle 17 would be held in the right hand, and the left hand would move the orifice around the dowel and into its seat in hole 14.

FIG. 11 shows a tier of the invention with the extra feature of an axial bore 38, through which a string 40 is drawn and then provided with an overhand knot 42 on its end. When neck 28 is rolled off of end 12, the overhand knot formed on neck 28 incorporates the string in the region 44 between overhand knot 42 and end 12. The balloon can then be slid along the string until it catches against the enlargement of the string caused by knot 42. A desired amount of additional string length is then drawn from bore 38 and the string cut. The side of the string remaining extending from the bore is provided with a new knot 42 for the next balloon, while the other side of the cut accompanies the just knotted balloon as its tether. In this way, the knotted balloons can each be provided with a holding string.

While FIG. 11 shows a string, it will be recognized that a ribbon, cord, stick, or other elongated balloon-tethering means can, as well, be brought through bore 38. Also, bore 38 can be offset from the axis, to extend through the slot-adjacent fingers 46*a* or 46*b* of the dowel, this as shown in U.S. Pat. No. 4,510,653, incorporated here by reference, in order that the tethering means be brought away from the slot 16, to prevent interference in the slot with neck 28.

Example of Dimensions

A device of the invention was a wooden cylinder of 0.75-inch diameter and approximately 6-inches long. Slot length, in the longitudinal direction of the cylinder, was ½-inch. For the case of a balloon having an orifice inner diameter of ½-inch, a bead 30 thickness of 3/32-inches, and an orifice outer diameter of 11/16-inches, a slot width in the range 3/32-inches to ⅛-inch , and a hole 14 diameter of ⅜-inches assures retention of the orifice in the hole during roll-off of the balloon from end 12. Slot widths in the mentioned range are wide enough to be useful for all the sizes of balloons ordinarily used for party purposes. These slot widths are not narrow enough to pinch the neck for effecting a neck seal against gas escape.

For best execution of the methods of the invention, it is preferred that there be sufficient friction between the balloon and the dowel to assure rolling of the balloon neck portion encircling the dowel, to twist the neck for improved gas seal, as the balloon is moved off end 12. A smooth, unfinished birch dowel has been found suitable, for instance. The dowel may also be dyed, or stained, for instance. A painted wooden dowel or an injection molded, plastic or polymer dowel may, as well, be used, provided that the paint or plastic composition is chosen to provide the sufficient friction.

The balloon tier of the invention is easy to use. Handicapped people, for instance the blind, can use it. It is, additionally, an ergonomically conceived tool for avoiding the repetitive strain which unaided fingers otherwise experience in the tying of large numbers of balloons for a party, for instance.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law. For example, the tying methods of Place (U.S. Pat. No. 5,314,217), FIG. 1, and Muma (U.S. Pat. No. 5,039,142), FIG. 5 (where the neck is looped around itself rather than using a single crossover as in FIG. 6 here and in FIG. 1 of Place), can be used. In either case, sliding the neck on land 20 facilitates bringing the neck into the slot, such that the orifice can then be released to rest in hole 14.

What is claimed is:

1. In a balloon tying device having a slot at an end for tying a knot in the neck of a balloon, the slot extending between an upper surface and a lower surface, the improvement comprising a stepping in of one side of the slot at the lower surface relative to the other side of the slot at the lower surface, to create a land for facilitating sliding of the neck of the balloon into the slot.

2. A balloon tying device as claimed in claim 1, wherein the improvement further comprises a round surface situated by the slot, whereby a gas seal may be achieved in the neck of the balloon by pressing of the neck against the round surface.

3. A balloon tying device as claimed in claim 1, wherein the improvement further comprises a hole whose axis extends transversely in the slot to a depth less than total thickness.

4. A balloon tying device as claimed in claim 3, wherein the improvement further comprises the feature that the slot extends to the axis of the hole.

5. A balloon tying device as claimed in claim 4, wherein the improvement further comprises that the slot terminates about at the axis of the hole.

6. A balloon tying device as claimed in claim 3, wherein the improvement further comprises the feature that the hole extends from the upper surface.

7. A balloon tying device as claimed in claim 1, wherein the improvement further comprises the feature that the device has sufficient friction to twist the neck of the balloon as the balloon is rolled off said end.

8. A balloon tying device as claimed in claim 1, wherein the improvement further comprises the feature that the slot has a width too wide to pinch the neck of the balloon to effect a neck seal against gas escape.

9. A balloon tier comprising a dowel having a slot at an end and having a hole whose axis extends transversely to the dowel in the slot to a depth less than total thickness, the slot extending between an upper surface and a lower surface, further comprising a stepping in of one side of the slot at the lower surface relative to the other side of the slot at the lower surface at said end, to create a land for facilitating sliding of the neck of a balloon into the slot.

10. A balloon tier as claimed in claim 9, further comprising the feature that the hole extends from the upper surface.

11. A balloon tier comprising a dowel having a slot at an end and having a hole whose axis extends transversely to the dowel in the slot to a depth less than total thickness, further comprising the feature that the dowel has sufficient friction to twist the neck of a balloon as the balloon is rolled off said end.

12. A balloon tier comprising a dowel having a slot at an end and having a hole whose axis extends transversely to the dowel in the slot to a depth less than total thickness, further comprising the feature that the slot at said end extends to the axis of the hole, further comprising the feature that the slot terminates about at the axis of the hole.

* * * * *